US005368226A

United States Patent [19]

Franceschino

[11] Patent Number: 5,368,226

[45] Date of Patent: Nov. 29, 1994

[54] MAIL SLOT POUCH APPARATUS

[76] Inventor: Luisa M. Franceschino, 3942 Kitten Cir., Huntington Beach, Calif. 92649

[21] Appl. No.: 144,311

[22] Filed: Nov. 1, 1993

[51] Int. Cl.[5] ..... A46G 29/12

[52] U.S. Cl. ..... 232/19; 232/33; 232/43.1

[58] Field of Search ..... 232/19, 17, 33, 1 E, 232/23, 30–32, 38; 248/101

[56] References Cited

U.S. PATENT DOCUMENTS

| | | | |
|---|---|---|---|
| 454,298 | 6/1891 | Shempp | 232/19 |
| 782,229 | 2/1905 | Field | 232/19 |
| 1,459,599 | 6/1923 | Minor | 232/43.1 |
| 2,829,820 | 4/1958 | Evers | 232/33 |
| 4,776,512 | 10/1988 | Moore | 232/19 |
| 4,785,960 | 11/1988 | Belisle | 232/33 |

FOREIGN PATENT DOCUMENTS

| | | | |
|---|---|---|---|
| 423813 | 2/1935 | United Kingdom | 232/19 |
| 759571 | 10/1956 | United Kingdom | 232/19 |
| 2243649 | 11/1991 | United Kingdom | 232/38 |

*Primary Examiner*—Flemming Saether
*Attorney, Agent, or Firm*—S. Michael Bender

[57] ABSTRACT

A new and improved mail slot pouch apparatus is provided for use with a door that has a mail slot therein. The apparatus includes a planar frame element for framing an interior opening of the mail slot. The planar frame element includes a plurality of frame apertures. Screws are employed for attaching the planar frame element through the frame apertures onto the door. A pouch assembly is attached to the door by the planar frame element. The pouch assembly includes a first opening which includes a pair of tubular edges which include a pair of rigid rods inserted into the tubular edges. The pouch assembly also includes a second opening which permits mail to be removed from the pouch assembly. The pouch assembly further includes a plurality of pouch apertures that are placed in registration with the frame apertures in the planar frame element for installation of the pouch assembly and the planar frame element onto the door by the fastening assemblies. The second opening may include a drawstring assembly located at a bottom of the pouch assembly. The drawstring assembly includes a string and a lock element for locking the string in a predetermined position around the second opening. Alternatively, a zipper assembly may be located in the pouch assembly for permitting selective access to mail retained in the pouch assembly. The zipper assembly may be located on a sidewall of the pouch assembly.

7 Claims, 4 Drawing Sheets

MAIL SLOT POUCH APPARATUS

BACKGROUND OF THE INVENTION

1. Field of the Invention

The present invention relates generally to devices for receiving mail delivered to a residence or business, and, more particularly, to a pouch especially adapted for receiving mail deposited in a mail slot in a door.

2. Description of the Prior Art

Various types of devices are used for receiving mail delivered to residences and businesses. Outdoor mailboxes have a number of disadvantages. They are exposed to extremes of weather, and they are often susceptible to unauthorized entry. Moreover, when an occupant of a dwelling goes on an extended vacation, the amount of mail that is received may cause an outdoor mailbox to overflow. For these reasons, mail slots in doors are especially desirable.

Throughout the years, a number of innovations have been developed relating to receptacles for receiving mail deposited in mail slots in door, and the following U.S. patents are representative of some of those innovations: U.S. Pat. Nos. 4,069,965; 4,776,512; and 5,029,753. More specifically, U.S. Pat. No. 4,069,965 discloses a mail slot pouch assembly that is affixed adjacent to a mail slot in a door. A separate and distinct planar support bracket is attached to the rear panel of the mail slot assembly. Moreover, a framework is provided for a bag receptacle, and the framework fits onto the planar support bracket. In this respect, it would be desirable if a device were provided for receiving mail from a mail slot in a door which does not require a separate and distinct planar support bracket attached to the rear panel of the mail slot assembly. Also, in this respect, it would be desirable if a device were provided for receiving mail from a mail slot in a door which does not require a framework for a bag receptacle that fits onto a separate planar support bracket.

U.S. Pat. No. 4,776,512 discloses a mail chute pouch that employs a flaccid pouch that has its opening end pressed against the door with the backplate for the mail slot. It is a difficult chore to place a flaccid opening of a bag under a metal plate and secure the metal plate in such a way that the opening of the flaccid bag remains properly open during installation and use. A heavy load of mail received by the flaccid bag may pull a portion of the opening of the bag out from between the backplate and the door. In this respect, it would be desirable if a device were provided for receiving mail from a mail slot in a door which provides for keeping the flaccid opening of a mail receiving bag in a open position during installation and use.

U.S. Pat. No. 5,029,753 discloses a garage door mail drop box that includes a receptacle with a sliding door. This mail box does not work with a door that is equipped with a mail slot.

The following U.S. patents may be of interest for their disclosure of receptacles that are associated with doors for the admittance of objects into the receptacles: U.S. Pat. Nos. 3,211,367 and 5,082,171.

Still other features would be desirable in a mail slot pouch apparatus. For example, if a person goes on an extended vacation and receives an excessively large amount of mail, it would be desirable if the mail received through the mail slot could be directed to an auxiliary container that is larger than the pouch associated with the mail slot.

When pieces of mail are removed from the pouch, often a person is elevated above the pouch. As a result, when a person removes mail from the pouch, the person is going against the force of gravity as the mail is removed. To ease the task of removing mail from the pouch, it would be desirable if the force of gravity could be used to assist the removal of mail from the pouch.

Thus, while the foregoing body of prior art indicates it to be well known to use bags for receiving mail dropped through a slot in a door, the prior art described above does not teach or suggest a mail slot pouch apparatus which has the following combination of desirable features: (1) does not require a separate and distinct planar support bracket attached to the rear panel of the mail slot assembly; (2) does not require a framework for a bag receptacle that fits onto a separate planar support bracket; (3) provides for keeping a flaccid opening of a mail-receiving bag in an open position during installation and use of the bag; (4) can direct mail to an auxiliary container that is larger than the pouch associated with the mail slot; and (5) can employ the force of gravity to assist the removal of mail from the pouch. The foregoing desired characteristics are provided by the unique mail slot pouch apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved mail slot pouch apparatus for use with a door that has a mail slot therein. The apparatus includes a planar frame element for framing an interior opening of the mail slot. The planar frame element includes a plurality of frame apertures. Fastening assemblies ar employed for attaching the planar frame element through the frame apertures onto the door. A pouch assembly is attached to the door by the planar frame element. The pouch assembly includes a first opening which includes a pair of tubular edges which include a pair of rigid rods inserted into the tubular edges. The pouch assembly also includes a second opening which permits mail to be removed from the pouch assembly. The pouch assembly further includes a plurality of pouch apertures that are placed in registration with the frame apertures in the planar frame element for installation of the pouch assembly and the planar frame element onto the door by the fastening assemblies. The fastening assemblies include screws which are screwed into the door. More specifically, the screws are inserted into frame apertures that are located in the planar frame element.

The second opening may include a drawstring assembly. The drawstring assembly is located at a bottom of the pouch assembly. The drawstring assembly includes a string and a lock element for locking the string in a predetermined position around the second opening. Alternatively, a zipper assembly may be located in the pouch assembly for permitting selective access to mail retained in the pouch assembly. The zipper assembly may be located on a sidewall of the pouch assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved mail slot pouch apparatus which has all of the advantages of the prior art and none of the disadvantages.

It is another object of the present invention to provide a new and improved mail slot pouch apparatus which may be easily and efficiently manufactured and marketed.

It is a further object of the present invention to provide a new and improved mail slot pouch apparatus which is of durable and reliable construction.

An even further object of the present invention is to provide a new and improved mail slot pouch apparatus which is susceptible of a low cost of manufacture with regard to both materials and labor, and which accordingly is then susceptible of low prices of sale to the consuming public, thereby making such mail slot pouch apparatus available to the buying public.

Still yet a further object of the present invention is to provide a new and improved mail slot pouch apparatus which does not require a separate and distinct planar support bracket attached to the rear panel of the mail slot assembly.

Still another object of the present invention is to provide a new and improved mail slot pouch apparatus that does not require a framework for a bag receptacle that fits onto a separate planar support bracket.

Yet another object of the present invention is to provide a new and improved mail slot pouch apparatus which provides for keeping a flaccid opening of a mail-receiving bag in an open position during installation and use of the bag.

Even another object of the present invention is to provide a new and improved mail slot pouch apparatus that can direct mail to an auxiliary. container that is larger than the pouch associated with the mail slot.

Still a further object of the present invention is to provide a new and improved mail slot pouch apparatus which can employ the force of gravity to assist the removal of mail from the pouch.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 2:
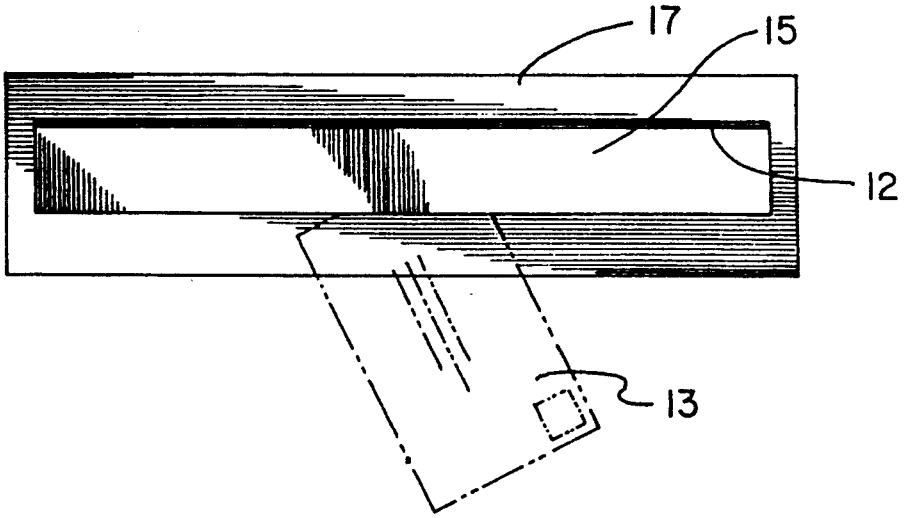
FIG. 2 is a front view of a door-mounted mail slot, viewed from the outside of the dwelling, with a letter being placed in the mail slot.

With reference to the drawings, a new and improved mail slot pouch apparatus embodying the principles and concepts of the present invention will be described.

Turning initially to FIGS. 1–4, there is shown a first exemplary embodiment of the mail slot pouch apparatus of the invention generally designated by reference numeral 10. In its preferred form, the mail slot pouch apparatus 10 is provided for use with a door 11 that has a mail slot 12 therein. The apparatus 10 includes a planar frame element 14 for framing an interior opening of the mail slot 12. The planar frame element 14 includes a plurality of frame apertures 28. Fastening assemblies 16 ar employed for attaching the planar frame element 14 through the frame apertures 28 onto the door 11. A pouch assembly 18 is attached to the door by the planar frame element 14. The pouch assembly 18 includes a first opening 20 which includes a pair of tubular edges 22 which include a pair of rigid rods 24 inserted into the tubular edges 22. The pouch assembly 18 also includes a second opening 26 which permits mail to be removed from the pouch assembly 18. The pouch assembly 18 further includes a plurality of pouch apertures 30 that are placed in registration with the frame apertures 28 in the planar frame element 14 for installation of the pouch assembly 18 and the planar frame element 14 onto the door 11 by the fastening assemblies 16. The fastening assemblies 16 include screws which are screwed into the door. More specifically, the screws 16 are inserted into frame apertures 28 that are located in the planar frame element 14.

Figure 1:
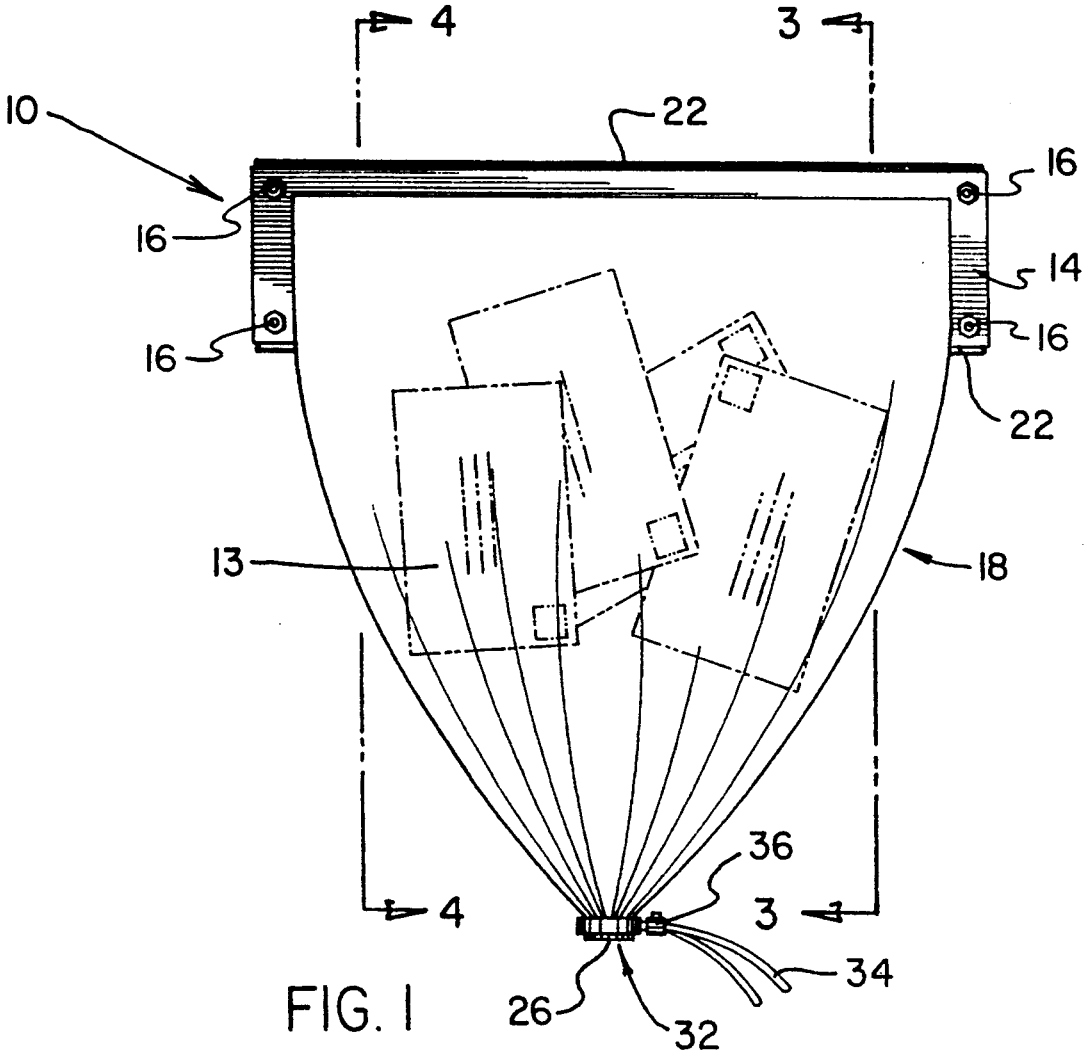
FIG. 1 is a front view a first preferred embodiment of the mail slot pouch apparatus of the invention installed on a door having a mail slot, wherein the apparatus is viewed from inside a dwelling, and wherein the pouch has an opening and drawstring located at the bottom of the pouch.
Figure 3:
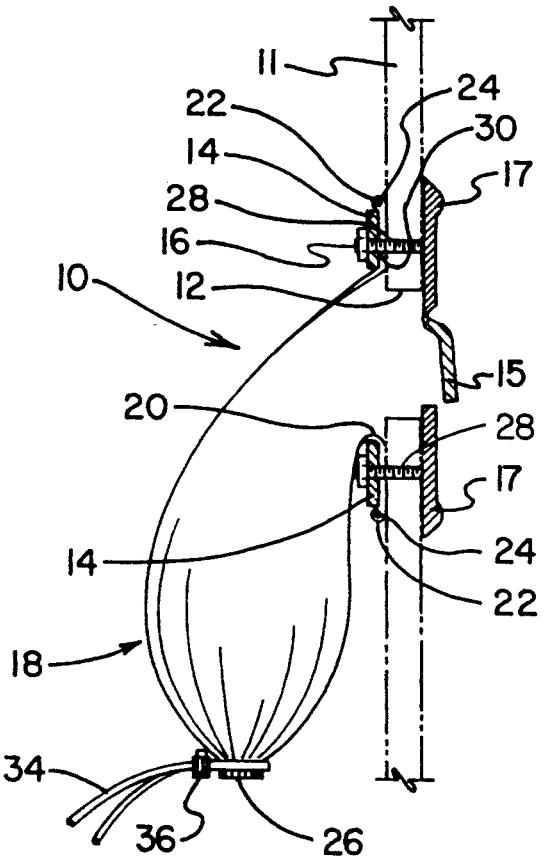
FIG. 3 is a partial cross-sectional view of the mail slot pouch apparatus of FIG. 1 taken along line 3—3 thereof.
Figure 4:
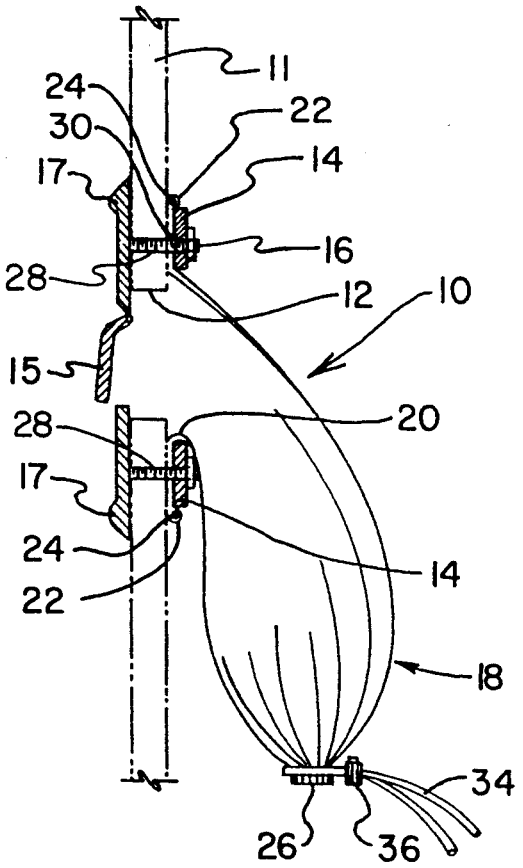
FIG. 4 is a partial cross-sectional view of the mail slot pouch apparatus of FIG. 1 taken along line 4—4 thereof.
Figure 5:
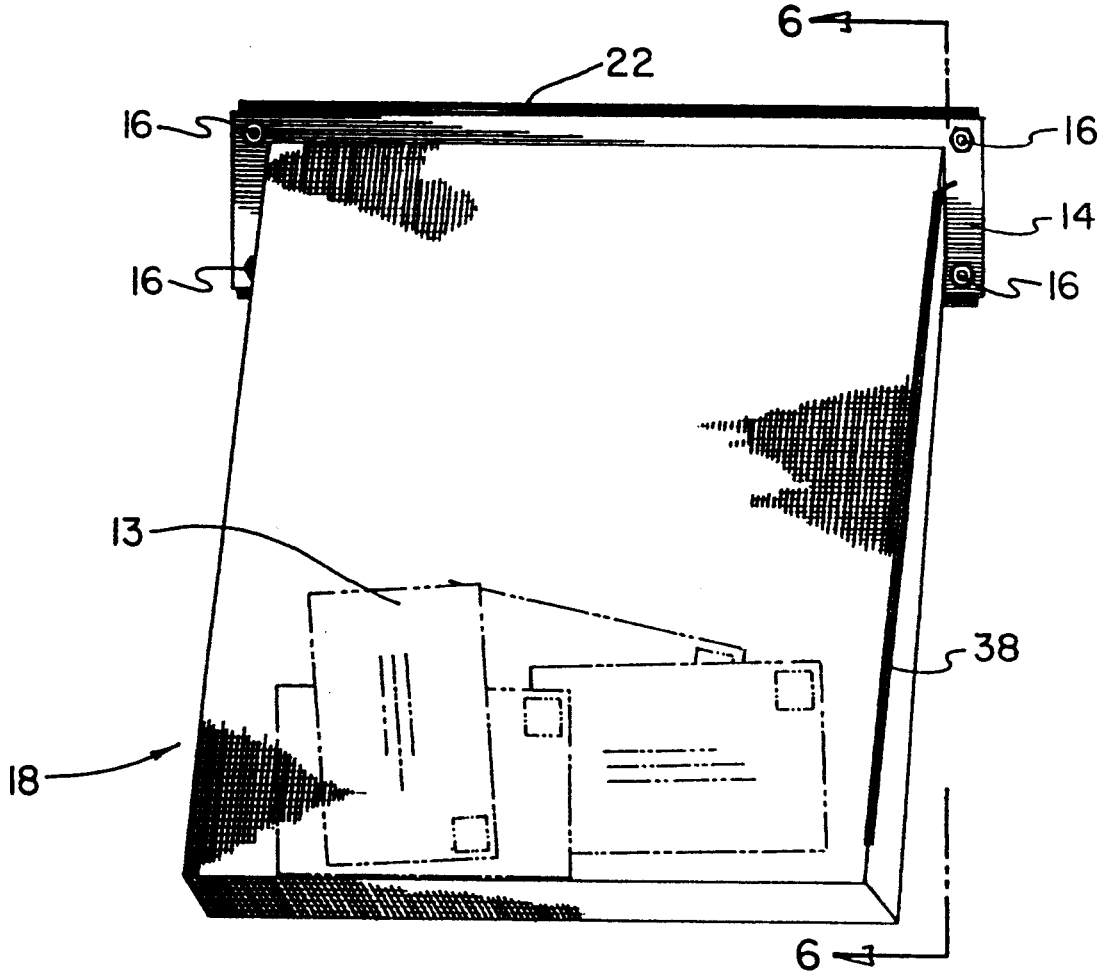
FIG. 5 is a front view a second preferred embodiment of the mail slot pouch apparatus of the invention installed on a door having a mail slot, wherein the apparatus is viewed from inside a dwelling, and wherein the pouch has a zipper and an opening in a side of the pouch.

The pouch assembly 18 may be made from a strong flaccid material. The material may be an opaque cloth (such as shown in FIG. 1) or a transparent film-like material. Alternatively, the pouch assembly 18 can be a mesh material (such as shown in FIG. 5), such as nylon mesh material, that permits a person to see through the pouch assembly 18 to ascertain how much mail is present.

A letter 13 is inserted into the mail slot 12 from the outside of the door in FIG. 2. A hinged door 15 generally covers the mail slot 12 when the mail slot 12 is not in use. An exterior frame plate 17, attached to the door 11, is generally used for decorative purposes and to support the hinged door 15.

To install the mail slot pouch apparatus 10 on the door, tour screws 16 are placed through four frame apertures 28 in the planar frame element 14. Four pouch apertures 30 of the pouch assembly 18 are placed in registration with the respective screws 16. This arrangement of pouch assembly 18, of planar frame element 14, and of screws 16 forms a partial preassembly. The partial preassembly is carried over to the mail slot 12 where the planar frame element 14 is pressed against the door. With the planar frame element 14 gently pressed against the door, the tubular edges 22 with their contained rigid rods 24 are moved to the respective upper and lower sides of the planar frame element 14 so that they will be located at the respective sides of the planar frame element 14 when the screws 16 are screwed into the door. The screws 16 may be screwed into previously made holes in the door, or the screws 16 may be self tapping, forming their own respective holes in the door. Once the screws 16 are tightened into the door, the tubular edges 22 with their rigid rods 24 are located at the respective top and bottom sides of the planar frame element 14, providing great strength for supporting the pouch assembly 18 on the door 11. Also, the first opening 20 of the pouch assembly 18 is fixed in an open position for receiving mail 13 dropped through the mail slot 12. The pouch apertures 30 may be reinforced to provide additional durability to the pouch assembly 18.

The second opening 26 includes a drawstring assembly 32. The drawstring assembly 32 is located at a bottom of the pouch assembly 18. The drawstring assembly 32 includes a string 34 and a lock element 36 for locking the string 34 in a predetermined position around the second opening 26. When the second opening 26 is bunched up, it is closed, and the drawstring assembly 32 is used to keep the second opening 26 closed for retaining the mail in the pouch assembly 18. However, when the drawstring assembly 32 is released, the second opening 26 is permitted to open, and the mail retained in the pouch assembly 18 is permitted to fall out of the pouch assembly 18 under the influence of the force of gravity.

Figure 6:
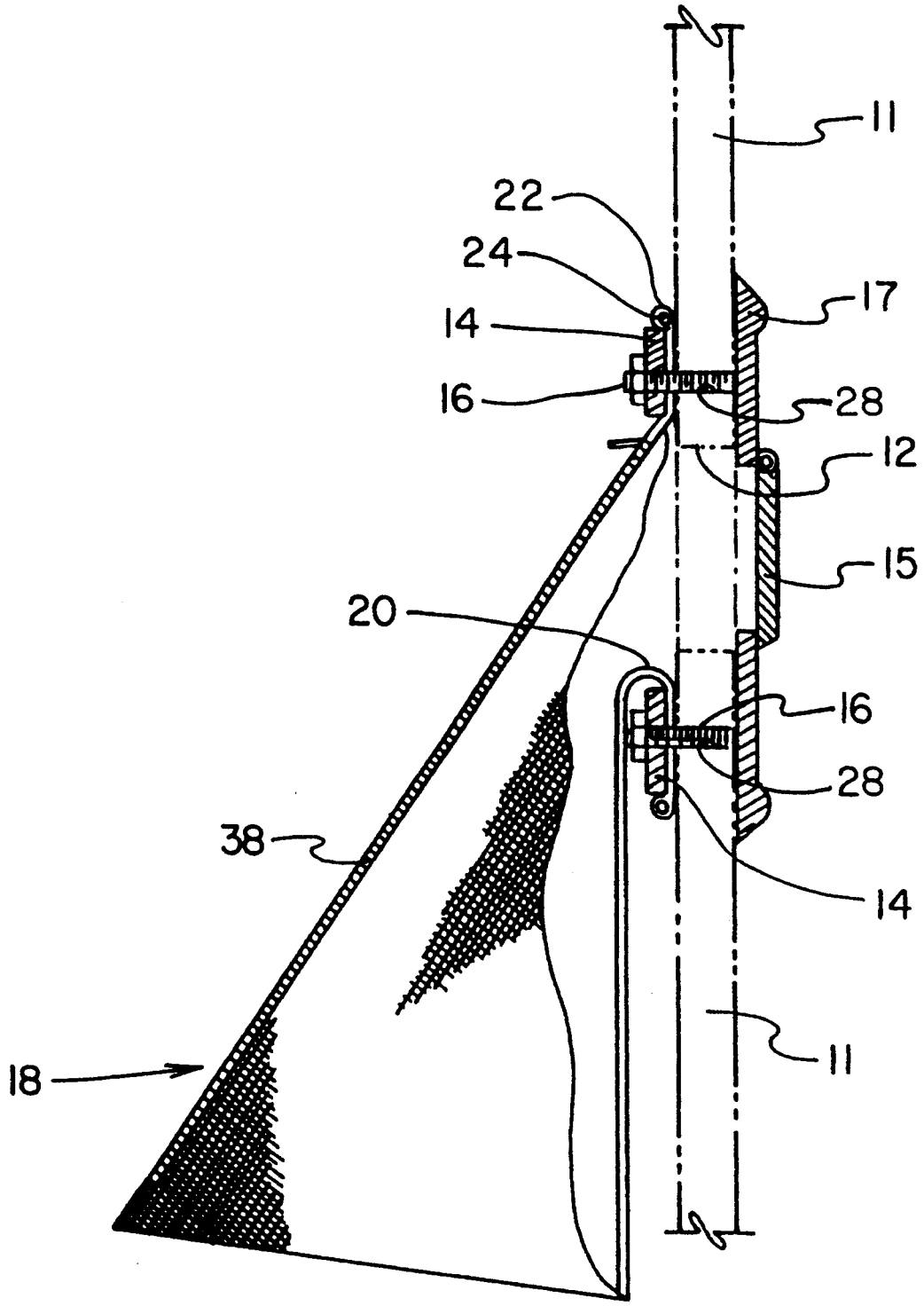
FIG. 6 is a partial cross-sectional view of the mail slot pouch apparatus of FIG. 5 taken along line 6—6 thereof.

Turning to FIGS. 5–6, a second embodiment of the invention is shown. Reference numerals are shown that correspond to like reference numerals that designate like elements shown in the other figures. In addition, a zipper assembly 38 is located in the pouch assembly 18 for permitting selective access to mail retained in the pouch assembly 18. The zipper assembly 38 is located on a sidewall of the pouch assembly 18.

Either the drawstring assembly 32 or the zipper assembly 38 can be used in an additional way. If it is anticipated that a large amount of mail will be collected over a period of time, that is an amount of mail that will exceed the capacity of the pouch assembly 18, then the respective second opening 26 may be left open over an auxiliary container (not shown) so that mail will pass through the pouch assembly 18 and exit out of the second opening 26 into the auxiliary, container. More specifically, for the embodiment of the invention shown in FIGS. 1–4, the drawstring assembly 32 can be left open over a container. For the embodiment of the invention shown in FIGS. 5–6, the zipper assembly 38 can be left open over the auxiliary container.

The components of the mail slot pouch apparatus of the invention can be made from inexpensive and durable metal, cloth, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved mail slot pouch apparatus that is low in cost, relatively simple in design and operation, and which may advantageously be used without requiring a separate and distinct planar support bracket attached to the rear panel of the mail slot assembly. With the invention, a mail slot pouch apparatus is provided which does not require a framework for a bag receptacle that fits onto a separate planar support bracket. With the invention, a mail slot pouch apparatus is provided which provides for keeping a flaccid opening of a mail-receiving bag in an open position during installation and use of the bag. With the invention, a mail slot pouch apparatus is provided which can direct mail to an auxiliary container that is larger than the pouch associated with the mail slot. With the invention, a mail slot pouch apparatus is provided which can employ the force of gravity to assist the removal of mail from the pouch.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved mail slot pouch apparatus for use with a door having a mail slot therein, said apparatus comprising:

a planar frame element for framing an interior opening of the mail slot, said planar frame element including a plurality of frame apertures, said planar frame element including an upper side and a lower side, fastening assemblies for attaching said planar frame element through said frame apertures onto the door, and a pouch assembly for attachment to the door by said planar frame element, wherein said pouch assembly includes a first opening which includes a pair of tubular edges which include a pair of independent rigid rods inserted into said tubular edges, wherein one of said rigid rods is located adjacent to said upper side of said frame member, wherein another of said rigid rods is located adjacent to said lower side of said frame member, and wherein said pouch assembly includes a second opening which permits mail to be removed from said pouch assembly.

2. The apparatus described in claim 1 wherein said pouch assembly further includes a plurality of pouch apertures that are placed in registration with said frame apertures in said planar frame element for installation of said pouch assembly and said planar frame element onto the door by said fastening assemblies.

3. The apparatus described in claim 1 wherein said second opening includes a drawstring assembly.

4. The apparatus described in claim 3 wherein said drawstring assembly is located at a bottom of said pouch assembly.

5. The apparatus described in claim 3 wherein said drawstring assembly includes:

a string, and a lock element for locking said string in a predetermined position around said second opening.

6. The apparatus described in claim 1, further including:

a zipper assembly located in said pouch assembly for permitting selective access to mail retained in said pouch assembly.

7. The apparatus described in claim 6 wherein said zipper assembly is located on a sidewall of said pouch assembly.

* * * * *